United States Patent [19]

Takase

[11] 4,090,349

[45] May 23, 1978

[54] ELECTRONIC MUSIC BOX CIRCUIT

[75] Inventor: Tsuneo Takase, Yokohama, Japan

[73] Assignee: Tokyo Shibaura Electric Co., Ltd., Tokyo, Japan

[21] Appl. No.: 785,090

[22] Filed: Apr. 6, 1977

[30] Foreign Application Priority Data

Apr. 8, 1976 Japan ..... 51-39586

[51] Int. Cl.[2] ..... G04B 21/08

[52] U.S. Cl. ..... 58/12; 58/16 D; 58/57.5; 84/1.01; 84/1.03; 84/1.24; 340/384 E; 58/23 R

[58] Field of Search ..... 84/1.01, 1.03, 1.27, 84/1.12, 1.21, 1.24, 1.26; 58/16 R, 16 D, 23 R, 57.5, 39, 12, 13; 340/384 R, 384 E, 392

[56] References Cited

U.S. PATENT DOCUMENTS

| | | | |
|---|---|---|---|
| 3,549,776 | 12/1970 | Shiga et al. | 84/1.03 |
| 3,637,914 | 1/1972 | Hiyama | 84/1.03 |
| 3,840,691 | 10/1974 | Okamoto | 84/1.03 |
| 3,861,263 | 1/1975 | Okudaira | 84/1.26 X |
| 4,010,667 | 3/1977 | Kniepkamp | 84/1.26 X |

*Primary Examiner*—Ulysses Weldon
*Attorney, Agent, or Firm*—Finnegan, Henderson, Farabow & Garrett

[57] ABSTRACT

An electronic music box circuit is provided which includes a pulse generator, a read only memory having address lines to be energized in a predetermined order by the output pulse signals from the pulse generator and memory cells arranged in accordance with a given melody, and a frequency-divider which divides the frequency of the output pulse signal from the pulse generator to produce a plurality of signals with different frequencies. In the read only memory, when one of the address lines is energized, a musical scale signal selection circuit and a signal level selection circuit are energized so that an output signal with a frequency selected from the output signals of the frequency divider is generated from the scale signal selection circuit while at the same time an output signal with a selected signal level is generated from the level selection circuit. The output signals from the scale signal and level signal selection circuits are supplied to a loudspeaker thereby to generate a predetermined sound.

12 Claims, 3 Drawing Figures

ELECTRONIC MUSIC BOX CIRCUIT

BACKGROUND OF THE INVENTION

The present invention relates to an electronic music box circuit.

In a conventional music box, various notes are produced by the vibration of steel teeth cut in a flat plate of steel. The teeth are acted upon by the revolution of a brass cylinder studded with projecting pins, which, as they rotate, raise and release the teeth at intervals according to the nature of the music. Such a mechanical type music box, however, has disadvantages that it is difficult to make the size thereof small and its durability is poor. To obtain a desired sound through the vibration of the steel teeth, it is required to form the teeth with extremely accurate width and length, resulting in expensive music boxes.

On the other hand, there have been various types of alarm clocks. A sound from such type of alarm clock is monotonous due to its constant amplitude and frequency. It is therefore required to develop an alarm clock with a music box which produces a pleasant sound. However, a conventional mechanical music box is bulky and the alarm clock having such a mechanical music box incorporated therein will be undesirably made bulky.

SUMMARY OF THE INVENTION

Accordingly, the primary object of the present invention is to provide an electronic music box circuit which is small in size and good in durability.

Another object of the present invention is to provide an electronic timepiece into which a small electronic music box circuit is incorporated.

According to one aspect of the preferred embodiments of the present invention, an electronic music box circuit comprises: a signal generating circuit for generating a plurality of signals with different frequencies; a memory circuit including a plurality of address lines and a plurality of output lines in which, when one of the address lines is selected, an output signal is delivered from at least one of the output lines; a signal selection circuit connected with said signal generating circuit and said memory circuit to generate a signal of which the signal level and frequency are determined by the output signal of said signal generator and the output signal from at least one selected of the output lines of said memory; and electrical to acoustic transducing means which is responsive to the output signal of said signal selection circuit and produces a sound signal corresponding to the output signal of said signal selection circuit.

Other objects and features of the present invention will be apparent from the following description taken in connection with the accompanying drawings, in which:

DESCRIPTION OF THE PREFERRED EMBODIMENTS

The description given below referring to the accompanying drawings is an embodiment of an electronic music box circuit according to the present invention.

Figure 1:
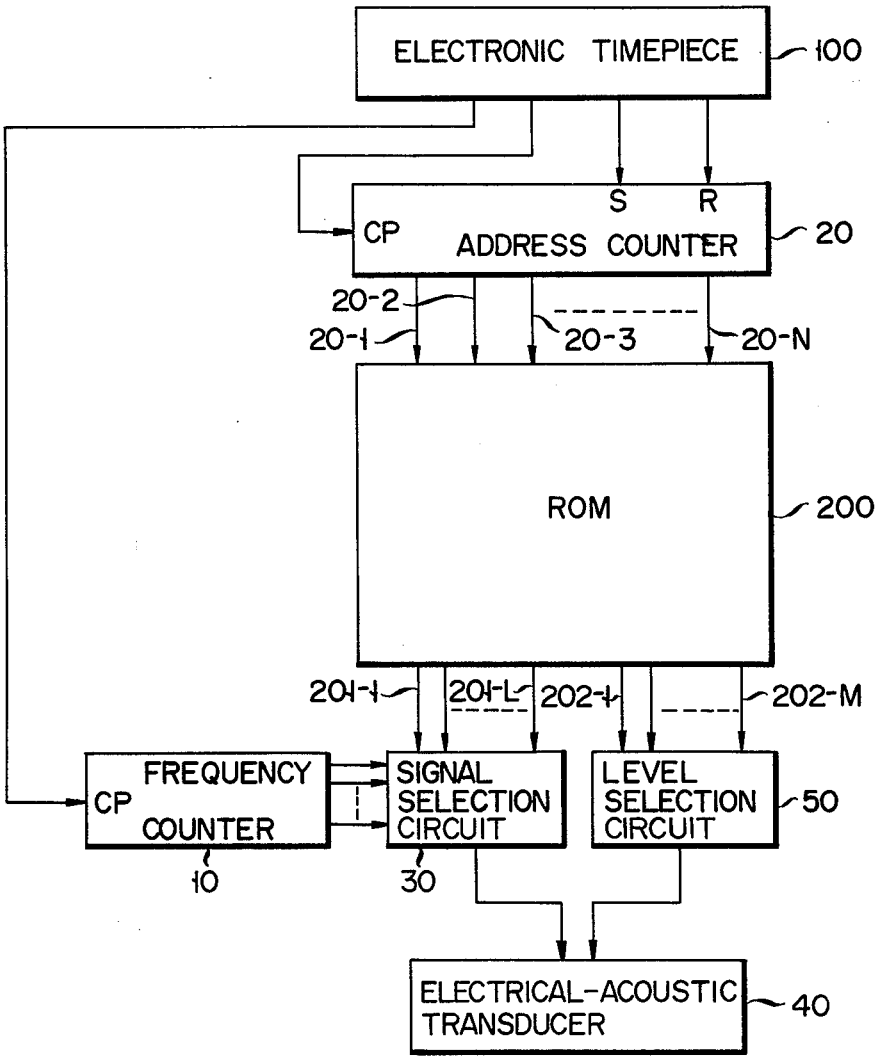
FIG. 1 shows a block diagram of an electronic music box circuit according to one embodiment of the present invention.

As shown in FIG. 1, a dynamic type electronic timepiece circuit 100 delivers a high frequency clock pulse signal of, for example, 16 KHz to the frequency counter 10 while at the same time clock pulses of $2^n$ Hz, e.g., 32 Hz, to an address counter 20. Additionally, the electronic timepiece 100 applies to set signal to the set terminal of the address counter 20 at a preset time, thereby to render the address counter 20 operative, and then after a predetermined time lapse applies a reset signal to the reset terminal of the address counter 20 thereby to stop the counting operation of the address counter 20. After receiving the set signal from the electronic timepiece circuit 100, the address counter 20 counts the clock pulses from the circuit 100 and delivers count output signals through output lines 20-1 to 20-N.

The output signal from the address counter 20 is supplied to a read only memory (ROM) 200 to selectively energize one of address lines of the ROM 200. As is well known, the ROM 200 is provided with a first group of output lines 201-1 to 201-L and a second group of output lines 202-1 to 202-M which are associated with the address lines through diodes or field effect transistors. The first group of output lines 201-1 to 201-L are coupled with a musical scale signal selection circuit 30 to which output signals with different frequencies are delivered from the frequency counter 10. When one of the address lines of the ROM 200 is selected, a signal with the frequency selected by one of the first group of output lines is produced from the scale selection circuit 30 to the electrical-acoustic tranducer 40. The second group of output lines 202-1 to 202-M of the ROM 200 are coupled with a signal level selection circuit 50. The signal level circuit 50 produces a signal of the level selected by one of the second group of output lines corresponding to the selected one of the address lines of the ROM 200, which in turn is fed to the electrical-acoustic transducer 40. In this manner, the electrical-acoustic transducer 40 generates a sound determined by the output signals from the scale signal selection circuit 30 and the signal level selection circuit 50. Preferably, the music box circuit shown in FIG. 1 is so designed that the ROM 200 is removably coupled with the address counter 20, scale signal selection circuit 30, and signal level selection circuit 50.

Figure 2:
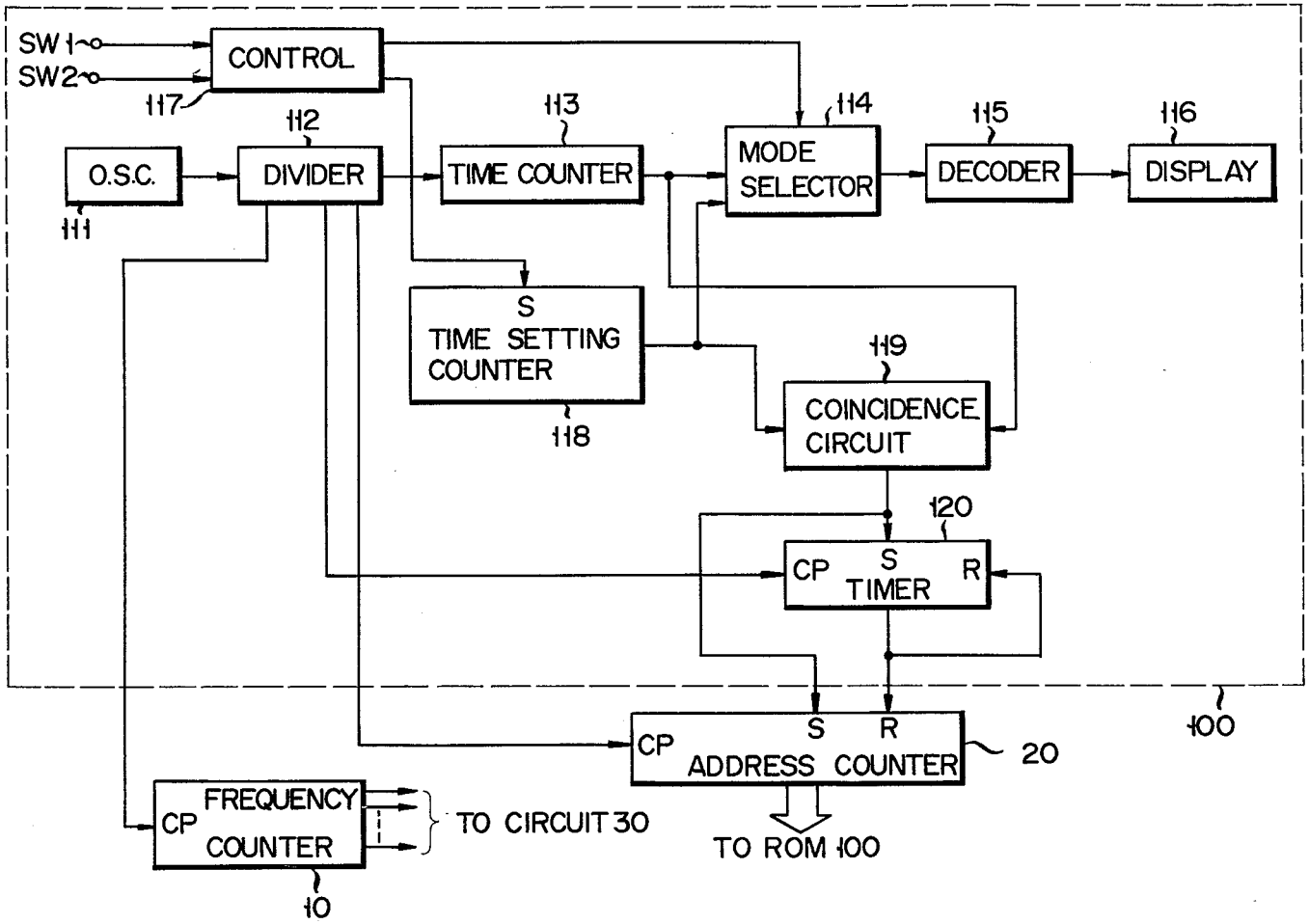
FIG. 2 is a block diagram of a timepiece circuit used in the music box circuit of FIG. 1.

Referring now to FIG. 2, there is shown a detail of the timepiece circuit 100 shown in FIG. 1. An oscillator 111 is comprised of, for example, a crystal oscillator generating high frequency pulses. A frequency dividing circuit 112 including a number of frequency dividers divides the frequency of the pulse signal from the oscillator 111 to feed to pulse signal of about 16 KHz as a clock pulse to the frequency counter 10 while at the same time a pulse signal of $2^n$ Hz, for example, 32 Hz as a clock pulse to the address counter 20. The frequency divider circuit 112 further supplies to a time counter 113 several kinds of pulses of, for example, 1 Hz, 60 Hz and 3600 Hz for time counting. The output signal of the time counter 113 is fed to a decoder 115 through a mode selector 114 where it is decoded. For example, the mode selector 114 is formed of a switching circuit whose condition can be changed according to the input signal.

Then, the time corresponding to the count in the time counter 113 is displayed in a display unit 116.

The condition of the mode selector 114 can be changed through the operation of the switch SW1 coupled with the input of a control circuit 117, formed of, for example, a series of shift registers. In a normal condition, the mode selector 114 is set to permit the count signal from the time counter 113 to pass therethrough. Where it is required to drive the music box at a desired time, the switch SW1 is first operated to set the mode selector 114 so that the count of the time setting counter 118 is displayed in the display unit 116, and then while observing the display unit 116, the content of the time setting counter 118 is set at a desired one through the output signal from the control circuit 117 by operating the switch SW1.

The time counter 113 continues counting and when a count corresponding to the preset time is reached, a coincidence circuit 119 detects the coincidence between the output counts of the time setting counter 118 and the time counter 113. At this time, the coincidence circuit 119 supplied an output signal to the set terminals S of a timer 120 and the address counter 20. Thus set, address counter 20 successively energizes the address lines of the ROM 100 in accordance with the output pulses from the frequency dividing circuit 112. After a predetermined time lapse, the timer 120 issues a reset signal which causes the address counter 20 and the timer 120 to stop the operations.

Figure 3:
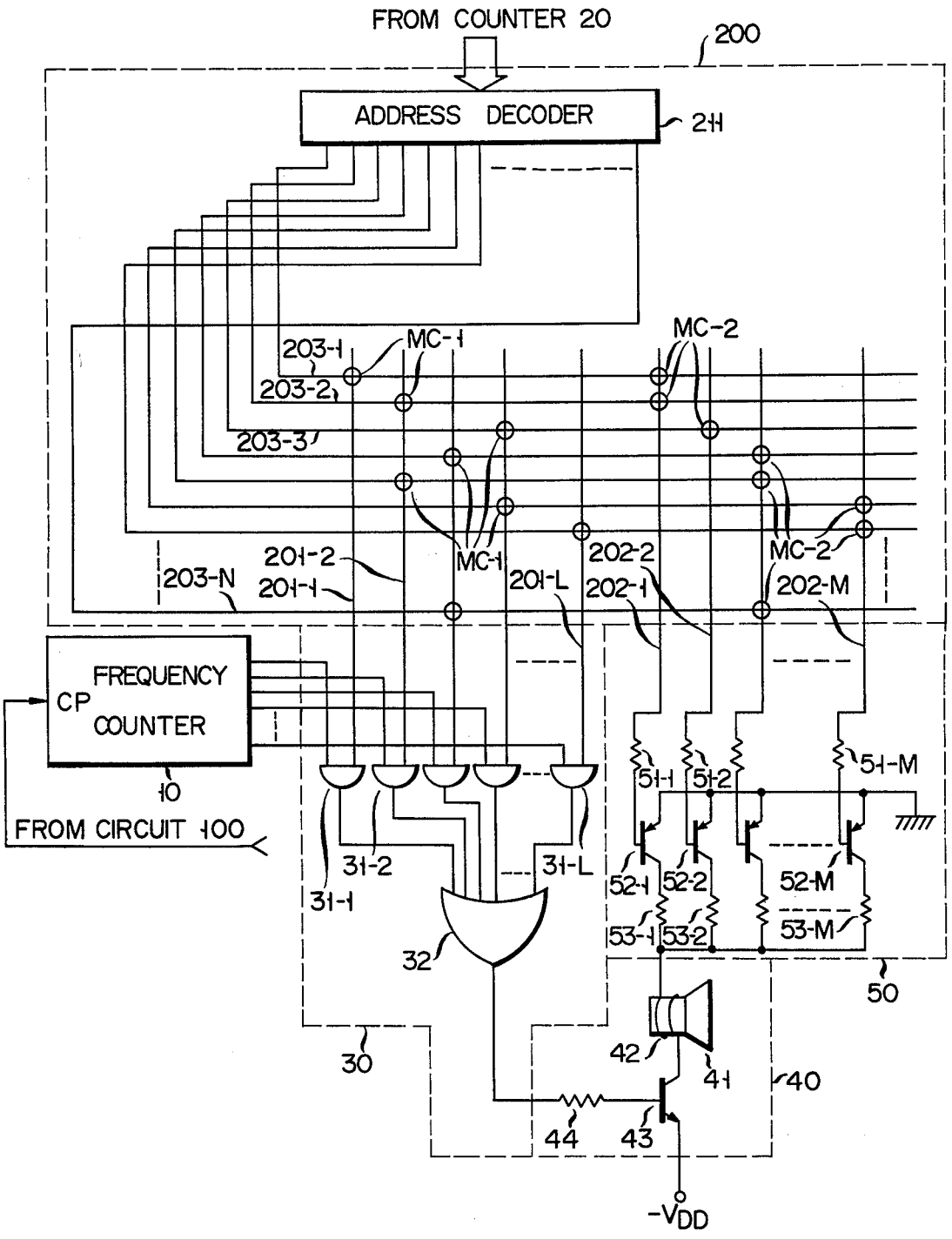
FIG. 3 is a circuit diagram including a read only memory, a musical scale signal selection circuit, a signal level selection circuit and an electrical-acoustic transducer, these being used in the FIG. 1 circuit.

Reference will be made to FIG. 3 illustrating the details of the ROM 200, the scale selection circuit 30, the electrical-acoustic transducer 40, and the signal level selection circuit 50.

The output count signal of the address counter 20 is transferred to the address decoder 211 of the ROM 200. The output signals from the address decoder 211 energize successively the address lines 203-1 to 203-N in a predetermined order. For example, when the address counter 20 is driven by the 32 Hz pulses, the respective address lines 203-1 to 203-N are successively energized in this order by the output signal from the address decoder 211 with an interval of 1/32 second.

The respective address lines 203-1 to 203-N are selectively associated with the first group of output lines 201-1 to 201-L through memory cells MC-1, and at the same time selectively associated with the second group of output lines 202-1 to 202-M through memory cells MC-2. As is well known, the ROM 200 is comprised of a diode matrix or insulated gate field effect transistors arranged in matrix. When one of the address lines 203-1 to 203-N is selected, the memory cells MC-1 and MC-2 permit the output lines of the first and second output lines associated with the selected one of the address lines to be energized. For example, when the address line 203-1 is selected, the first output line 201-1 and the second output line 202-1 are driven. When the address line 203-2 is selected, the first output line 201-2 and the second output line 202-1 are energized. These memory cells MC-1 and MC-2 are arranged at predetermined positions in accordance with desired melody.

The first output lines 201-1 to 201-L of the ROM 200 are connected with AND gates 31-1 to 31-L of the scale signal selection circuit 30, respectively. These AND gates are also connected at the other inputs to the outputs of the frequency counter 10 for receiving output signals with different frequencies $f_1$ to $f_L$. The output signals of these AND gates 31-1 to 31-L are coupled with the electrical-acoustic transducing circuit 40 through an OR gate 32. The second output lines 202-1 to 202-M are connected with the bases of npn transistors 52-1 to 52-M of the signal level selection circuit 50, through resistors 51-1 to 51-M. The emitters of the transistors 52-1 to 52-M are grounded and the collectors thereof are connected with one end of a voice coil 42 of a loudspeaker 41 in the electrical-acoustic transducing circuit 40, through resistors 53-1 to 53-M, respectively. The voice coil 42 is connected at the other end to the collector of a transistor 43 of which the base is connected through a resistor 44 to the OR gate 32 and the emitter is connected to a negative power source $V_{DD}$. The resistors 53-1 to 53-M connected to the collectors of the transistors 52-1 to 52-M have different values so as to determine the levels of the respective current flowing through the emitter to collector circuits of the transistors 52-1 to 52-M.

When the output signal of the address decoder 211 selects the address line 203-1, for example, the first output line 201-1 and the second output line 202-1 are energized, as explained above. The energization of the first output line 201-1 enables the AND gate 31-1 so that the output signal with the frequency $f_1$ from the frequency counter 10 is applied to the base of the transistor 43 through the AND gate 31-1, OR gate 32, and resistor 44. The energization of the second output line 202-1 makes the transistor 52-1 conductive so that the current with the current value determined by the resistor 53-1 is supplied to the voice coil 42 of the loudspeaker 41. In this way, the current whose current value depends on the resistor 53-1 and whose frequency is $f_1$, flows through the voice coil 42 of the loudspeaker 41, with the result that a specified sound is produced from the loudspeaker 41.

In FIG. 3, the memory cells MC-1 and MC-2 are disposed at appropriate positions, for the purpose of simplicity. However, in case where the address lines are energized successively every 1/32 second, if it is desired to obtain the ¼ second continuation of the same sound, the memory cells MC-1 and MC-2 are arranged so that eight successive address lines can be associated with the first and second output lines.

It will be understood that the present invention is not limited to the above-mentioned embodiment. In the above-mentioned embodiment, when a single address line is selected, a single first output line associated with the selected one is energized. However, it is possible that the memory cells MC-1 are so disposed that a single address line is associated with two or more first output lines. Further, a piezoelectric element may be used for the electrical-acoustic transducer which is constituted by an ordinary loudspeaker in the above-mentioned example.

Although the above-mentioned example is the case where the music box circuit is incorporated into the timepiece circuit, if a pulse signal generator controlled by one or more manually operable switches is used in place of the timepiece circuit 100, an independent music box circuit may be constructed.

If another melody is needed in the music box described above, the ROM must be exchanged for another which records such a melody therein. Instead of the ROM, a random access memory may also be used whose stored contents of melody may be easily changed from exterior without removal thereof.

The timepiece circuit 100 in the example is so designed to generate set and reset signals to the address counter 20. Alternately, the timepiece circuit 100 may be so designed to generate only one of the set and reset signals and the other necessary signal can be manually supplied to the address counter 20.

In the example, the output signal of the frequency divider 112 of the timepiece circuit 100 is supplied to the frequency counter 10 of which the plurality of output signals with different frequencies are applied to the scale selection circuit 30. Alternately, it is possible that the plurality of signals with different frequencies are obtained directly from the frequency divider 112, if the frequency divider is so designed, or the frequency counter 10 can be incorporated into the timepiece circuit 100.

What is claimed is:

1. An electronic timepiece circuit comprising:

timepiece means including a signal generating circuit for generating a plurality of signals with different frequencies and a time counting circuit for counting at least one output signal from said signal generating circuit to measure time;

an address designation circuit connected to one of the output terminals of said signal generating circuit to produce an address designation signal;

a semiconductor memory circuit including a plurality of address lines selectively energized by said address designation signal, a plurality of first output lines and a plurality of second output lines in which, when one of the address lines is energized, an output signal is delivered through at least one of the first output lines selected by said energized address line and one of the second output lines selected by said energized address line;

a signal selection circuit including a scale signal selection circuit and a signal level selection circuit, said scale signal selection circuit being comprised of a plurality of AND gates whose first input terminals are respectively connected to the first output lines of said memory circuit and whose second input terminals are respectively connected to the output terminals of said signal generating circuit, and an OR gate connected to the output terminals of said AND gates, and said signal level selection circuit being comprised of a plurality of first transistors whose bases are connected to the respective output lines of said memory circuit; and electrical-to-acoustic transducing means connected to the output terminal of said OR gate and to the collectors of said first transistors to produce a sound signal whose frequency and amplitude are determined by the output signals from said OR gate and said first transistors.

2. An electronic timepiece circuit according to claim 1, wherein said semiconductor memory circuit is a read only memory.

3. An electronic timepiece circuit according to claim 1, wherein said address designation circuit includes an address counter which is connected to one of the output terminals of said signal generating circuit and an address decoder connected to the address counter to selectively supply an address signal to one of the address lines of said memory circuit.

4. An electronic timepiece circuit according to claim 1, wherein said signal generating circuit includes a pulse generator and frequency dividers for dividing the frequency of the output signal of said pulse generator to produce said plurality of signals with different frequencies.

5. An electronic timepiece circuit according to claim 1, wherein said timepiece means further comprises a time setting circuit which can be operated from exterior to set a desired time and a coincidence circuit which produces a coincidence signal as a set signal to said address designation circuit when the content of said time counting circuit reaches a count corresponding to the time set by said time setting circuit.

6. An electronic timepiece circuit according to claim 5, wherein said timepiece means further includes a timer which is responsive to said coincidence signal from said coincidence circuit and, after a predetermined time, delivers a reset signal to said address designating circuit.

7. An electronic timepiece circuit according to claim 1, wherein said timepiece means further includes a time setting circuit which is operable from the exterior to set a desired time and a coincidence circuit which produces a coincidence signal when the content of said time counting circuit reaches a count corresponding to the time set by said time setting circuit, and a timer which is responsive to said coincidence signal from said coincidence circuit and, after a predetermined time, delivers a reset signal to said address designation circuit.

8. An electronic music box circuit comprising:

a signal generating circuit having a plurality of output terminals to generate a plurality of signals with different frequencies;

an address designation circuit connected to one of the output terminals of said signal generating circuit to produce an address designation signal;

a semiconductor memory circuit including a plurality of address lines selectively energized by said address designation signal, a plurality of first output lines and a plurality of second output lines in which, when one of the address lines is energized, an output signal is delivered through at least one of the first output lines selected by said energized address line and one of the second output lines selected by said energized address line;

a signal selection circuit including a scale signal selection circuit and a signal level selection circuit, said scale signal selection circuit being comprised of a plurality of first gates whose first input terminals are respectively connected to the first output lines of said memory circuit and whose second input terminals are respectively connected to said output terminals of said signal generating circuit, and said signal level selection circuit being comprised of a plurality of second gates, an input of each second gate being connected to a respective second output lines of said memory circuit; and electrical-to-acoustic transducing means connected to the output terminals of said first gates and to the output terminals of said second gates to produce a sound signal whose frequency and amplitude are determined by the output signals from said first and second gates, respectively.

9. An electronic music box circuit according to claim 8, wherein an OR gate is connected between the output terminals of said first gates and said transducing means.

10. An electronic music box circuit according to claim 8, wherein said semiconductor memory circuit is a read only memory.

11. An electronic music box circuit according to claim 8, wherein said address designation circuit includes an address counter which is connected to one of the output terminals of said signal generating circuit and an address decoder connected to the address counter to selectively supply an address signal to one of the address lines of said memory circuit in response to the signal at said one of the output terminals of said signal generating circuit.

12. An electronic music box circuit according to claim 8, wherein said signal generating circuit includes a pulse generator and frequency dividers for dividing the frequency of the output of said pulse generator to produce said plurality of signals with different frequencies.

* * * * *